US006086221A

United States Patent [19]

Wu

[11] Patent Number: 6,086,221

[45] Date of Patent: Jul. 11, 2000

[54] LAND LAMP DEVICE

[76] Inventor: Jeng-Shyong Wu, No. 14, Alley 1, Lane 326, Shyr-Piin Road, Hsin-Chu City, Taiwan

[21] Appl. No.: 09/071,125

[22] Filed: Apr. 30, 1998

[51] Int. Cl.[7] ..... F21V 3/00; F21S 13/10

[52] U.S. Cl. ..... 362/249; 362/431; 362/391; 362/806

[58] Field of Search ..... 362/431, 806, 362/410, 414, 249, 392

[56] References Cited

U.S. PATENT DOCUMENTS

| | | | |
|---|---|---|---|
| 3,866,034 | 2/1975 | Russo . | |
| 5,178,454 | 1/1993 | Lai . | |
| 5,297,013 | 3/1994 | Hall et al. | 362/363 |
| 5,398,180 | 3/1995 | Lee | 362/431 |
| 5,483,432 | 1/1996 | Wang | 362/363 |
| 5,526,243 | 6/1996 | Masters | 362/431 |
| 5,692,828 | 12/1997 | Chung | 362/431 |

*Primary Examiner*—Thomas M. Sember
*Attorney, Agent, or Firm*—McGlew and Tuttle, P.C.

[57] ABSTRACT

A lamp device is provided with a string having a plurality leads, a plurality lamp sockets and a plurality bulbs. A plurality of posts having a tip portion at one end and a fastening portion at the other end and a connecting plate with an upper plate portion connected to the fastening portion and a lower plate portion connected to the tip portion are provided. The top portion has two tips providing a fork forming a recess on the lower plate portion of the connecting plate. The fastening portion has two protection walls, each protection wall having an extension piece formed thereon, each extension piece having an upper lug and a lower lug providing a recess between the upper lug and the lower lug, the tip portion being able to be inserted into the ground or into something loose to support the lamp device. A plurality of lamp covers are provided. The fastening portion of each post is connected to an associated lamp socket of the sockets, with an associated bulb of the bulbs and an associated one of the covers or to the tip portion of another post to form a lengthened post. Each lamp cover has one of various patterns formed thereon, each lamp cover has a bottom with a fastening portion for securely connecting the lamp cover to the fastening portion of the post or to the associated lamp socket. The associated bulb is disposed substantially centrally inside the cover whereby reflection or deflection of light by the cover results in various decorative patterns as the bulb when the bulb is lighting. The lamp cover has a hollow portion inside defining a hole. The hole cooperates with the fastening portion, with the fastening portion providing a clamping along the edge of the hole.

19 Claims, 8 Drawing Sheets

FIG. 7C
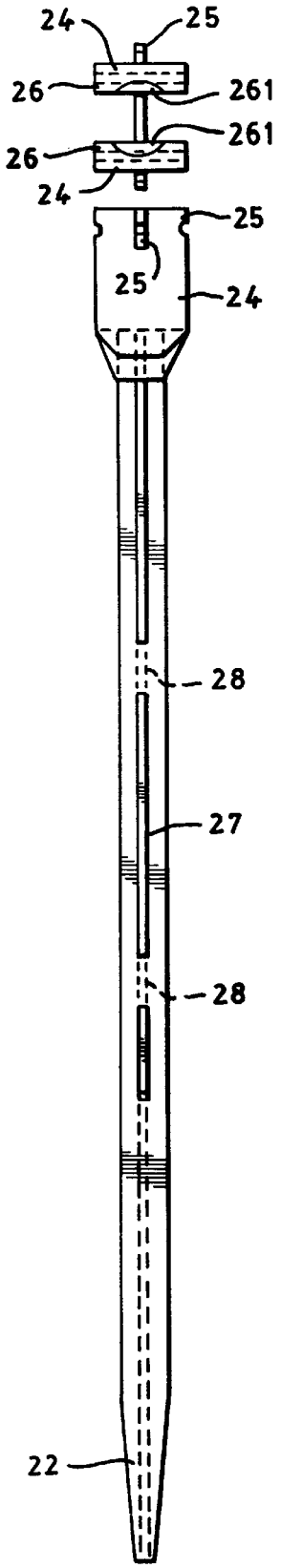
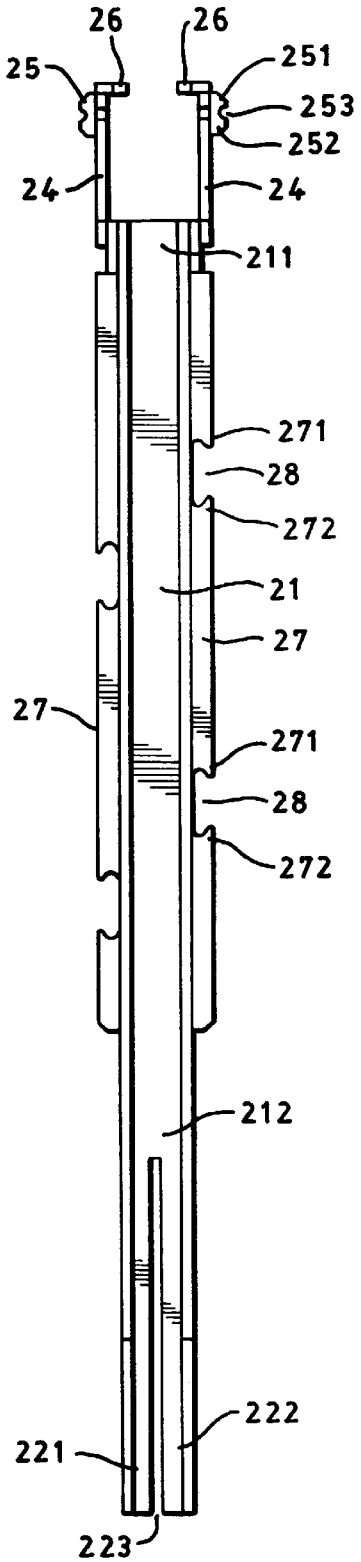
FIG. 7A FIG. 7B

LAND LAMP DEVICE

BACKGROUND OF THE INVENTION

Conventional lamp devices, such as Post Cap Lamp and Decorative Lamp Post disclosed in U.S. Pat. Nos. 3,866,034 and 5,178,454 respectively, inevitably have some drawbacks that, for example, a lamp socket and bulb have to be set only on lamp cover decoration or a bulb can not be positioned in the location as required. In general, it is the best way that the bulb can be fixed at the center of the decoration. It is an object of the invention to provide a lamp device, in which a lamp socket and cover can be fixed on post to achieve convenience and stability for use, thereby solving the problem in prior art.

BRIEF DESCRIPTION OF THE DRAWNINGS

FIG. 7A, 7B are front view and side view of the post of the land lamp device in accordance with the present invention.

DETAILED DESCRIPTION OF THE INVENTION

Figures 1A, 1B, 1C:
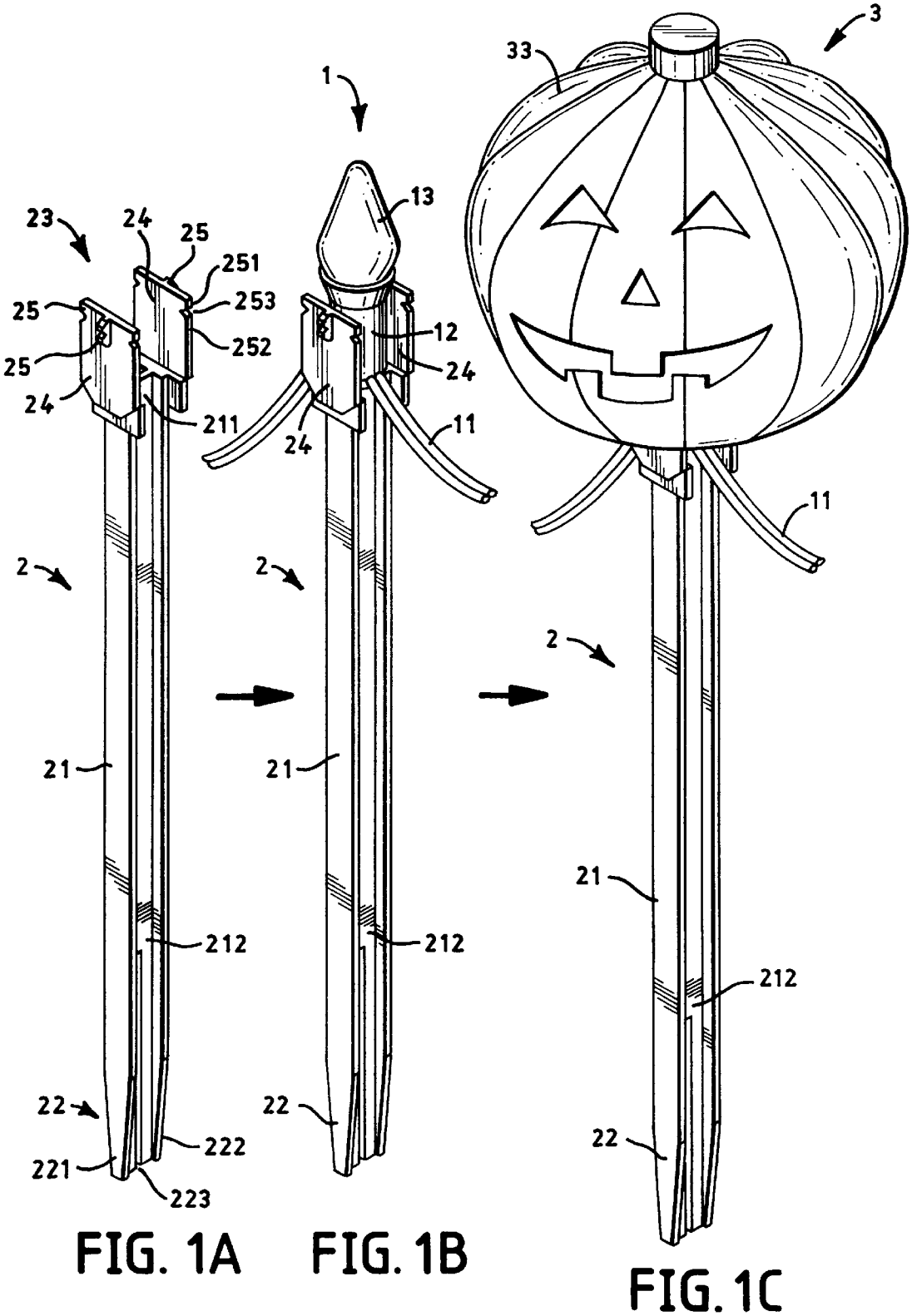
FIGS. 1A, 1B, 1C show the assembly of the lamp device in accordance with the present invention.
Figure 2:
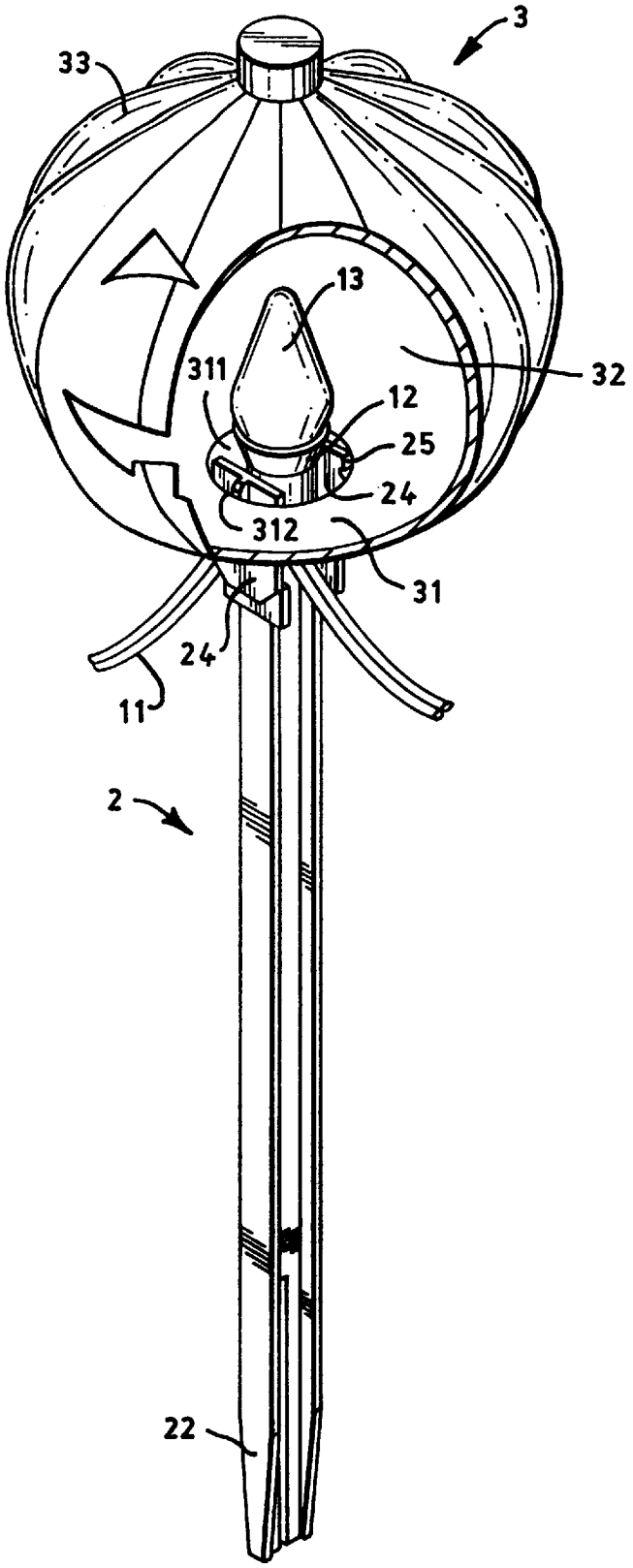
FIG. 2 is a cross-sectional view showing the land lamp device in accordance with the present invention.
Figure 3A:
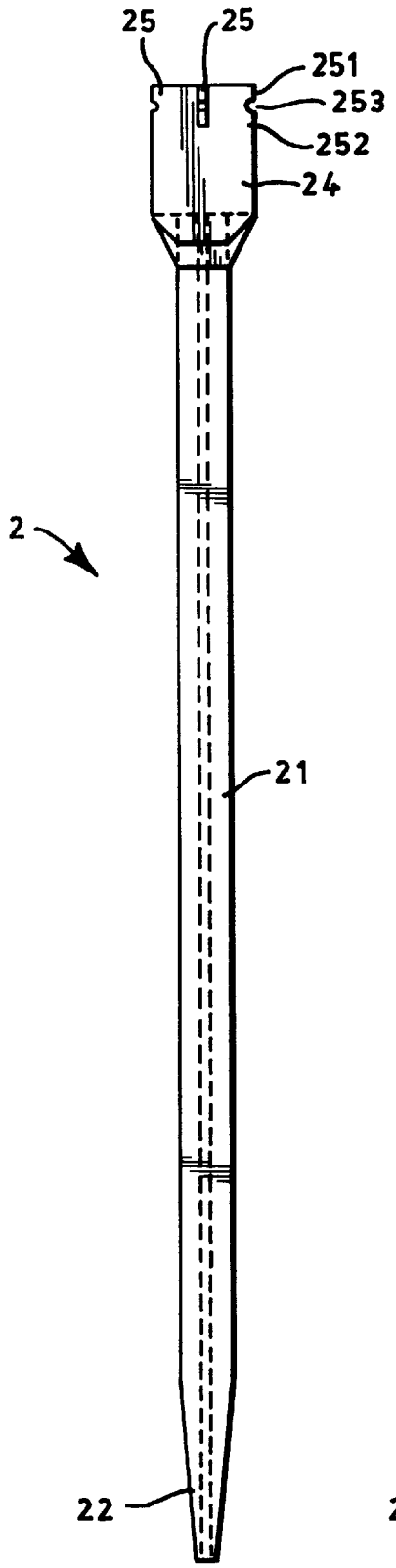
FIG. 3A, 3B show the assembly of the land lamp device in accordance with the prevent invention.
Figure 3B:
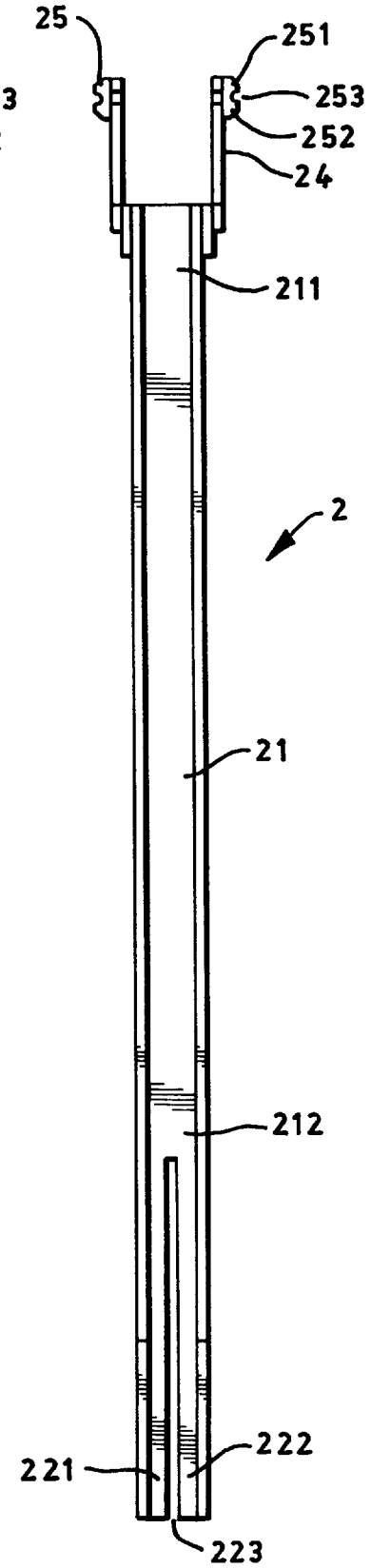

Referring to FIGS. 1, 2, 3, the land lamp device according to the invention comprises a light string 1, a post 2 and a lamp cover. The light string 1 is composed of multiple leads 11, a lamp socket 12 and a bulb 13. The post 2 has a connecting plate 21 including a upper plate or upper plate portion 211 and a lower plate or lower plate portion 212. The upper plate 211 is connected to a fastening portion 23 which has two protection walls 24. On the upper end of the protection walls 24, multiple extension pieces 25 are formed. The extension piece 25 has a upper lug 251 and a lower lug 252 with a recess 253 formed between. The lower plate 212 is connected to a tip portion 22 which has two tips 221,222 in form of fork to form a recess 223 between. The lamp cover 3 has a hollow portion 32 inside and a decoration 31 with a hole 311 on a fastening portion 31, in which a clamp 312 is set along the edge of the hole. For assembly, the lamp socket 12 of the light string 1 are installed between said two protection walls 24 of the fastening portion 23 and the bottom of the socket 12 is firmly connected to the upper plate 211 of the connecting plate 21. The leads 11 extend down from one side or both sides of the lamp socket 12. The hole 311 on the lamp cover 3 is set on the extension pieces 25 through the bulb 13. Elastic notches or crevices (not shown) can be formed on the clamp 312, such that the clamp 312 can be clamped to the recess 253 between the upper lug 251 and lower lug 252 on the extension pieces 25. Therefore, while the bulb 13 or socket 12 is put inside the decoration 33, reflection or deflection of light form the bulb 13 by the decoration 33 results the various decorative patterns as the bulb 13 is lighting. Furthermore, two tips 221,222 connected to the lower plate 212 of the post 2 can be inserted into land or something loose to stand the land lamp.

Figure 4A:
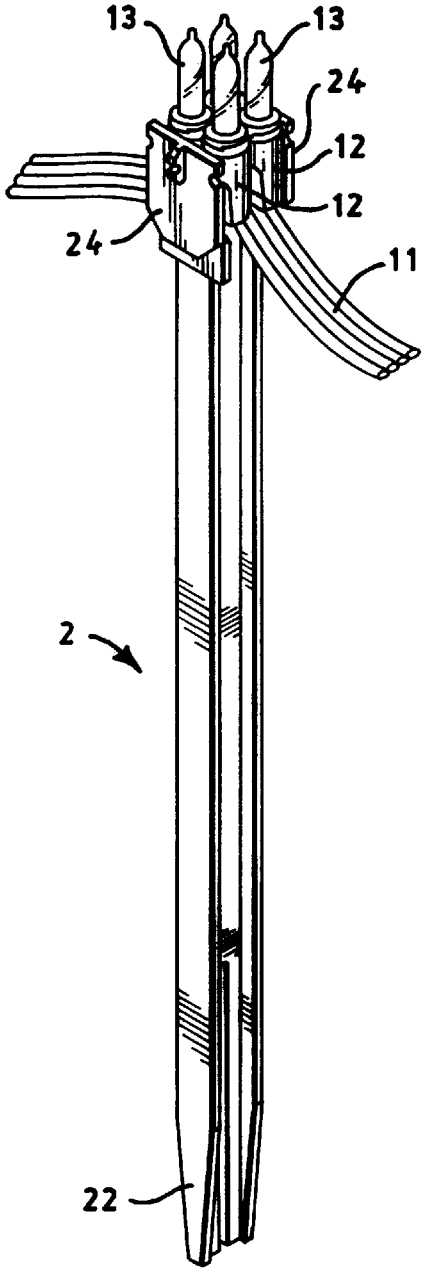
FIG. 4 is a cross-sectional view showing the land lamp device in accordance with the present invention.
Figure 4B:
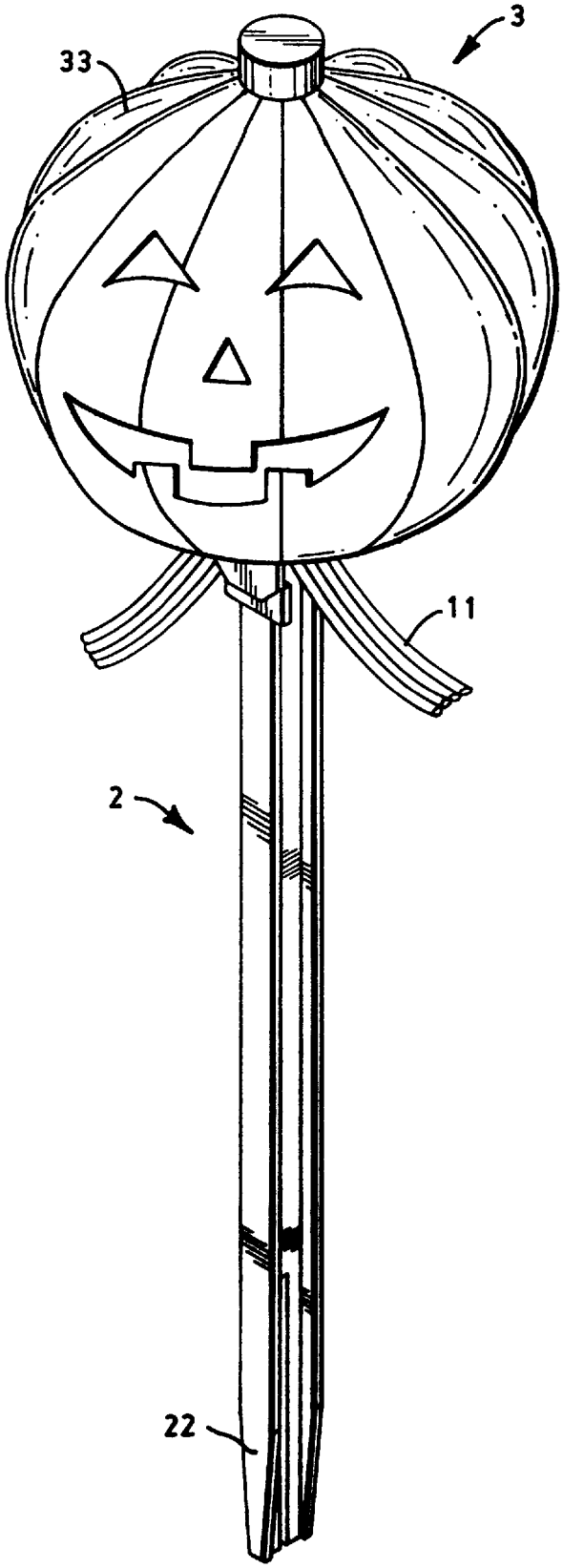
Figure 5:
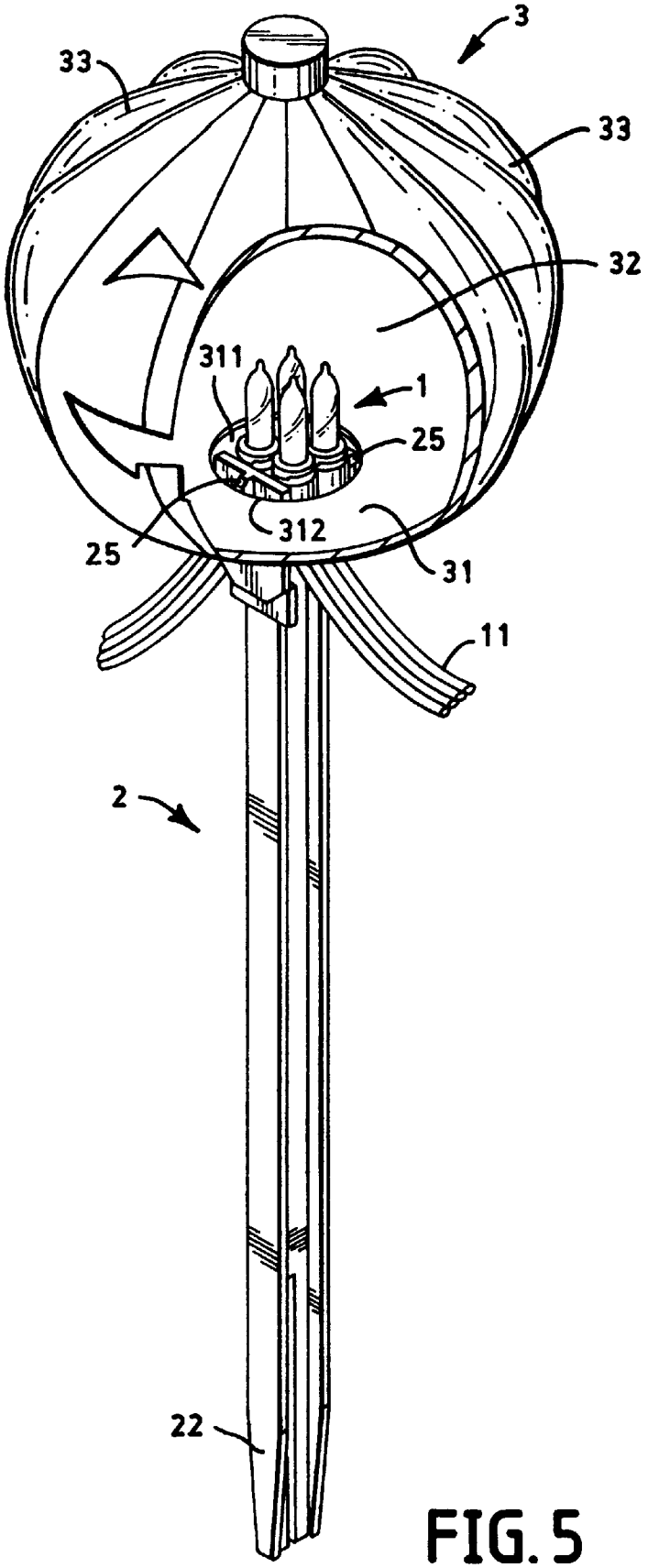
FIG. 5A, 5B are front view and side view of the post of the land lamp device in accordance with the present invention.

Referring to FIGS. 4,5, the land lamp device according to the invention comprises a light string 1, a post 2 and a lamp cover. The light string 1 is composed of multiple leads 11, a lamp socket 12 and a bulb 13. The post 2 has a connecting plate 21 with its upper end connected to two protection walls 24, on which multiple extension pieces 25 are formed. The lamp cover 3 has a hollow portion 32 inside and a decoration 31 with a hole 311 on a fastening portion 31, in which a clamp 312 is set along the edge of the hole. For assembly, the lamp socket 12 of the light string 1 are installed between said two protection walls 24 of the fastening portion 23 and the bottom of the socket 12 is firmly connected to the upper plate 211 of the connecting plate 21. The leads 11 extend down from one side or both sides of the lamp socket 12. The hole 311 on the lamp cover 3 is clamped on the extension pieces 25 through the bulb 13. Therefore, while multiple bulbs 13 or sockets 12 are put inside the decoration 33, reflection or deflection of light form the bulb 13 by the decoration 33 results the various decorative patterns as the bulb 13 is lighting.

Figures 6A, 6B, 6C:
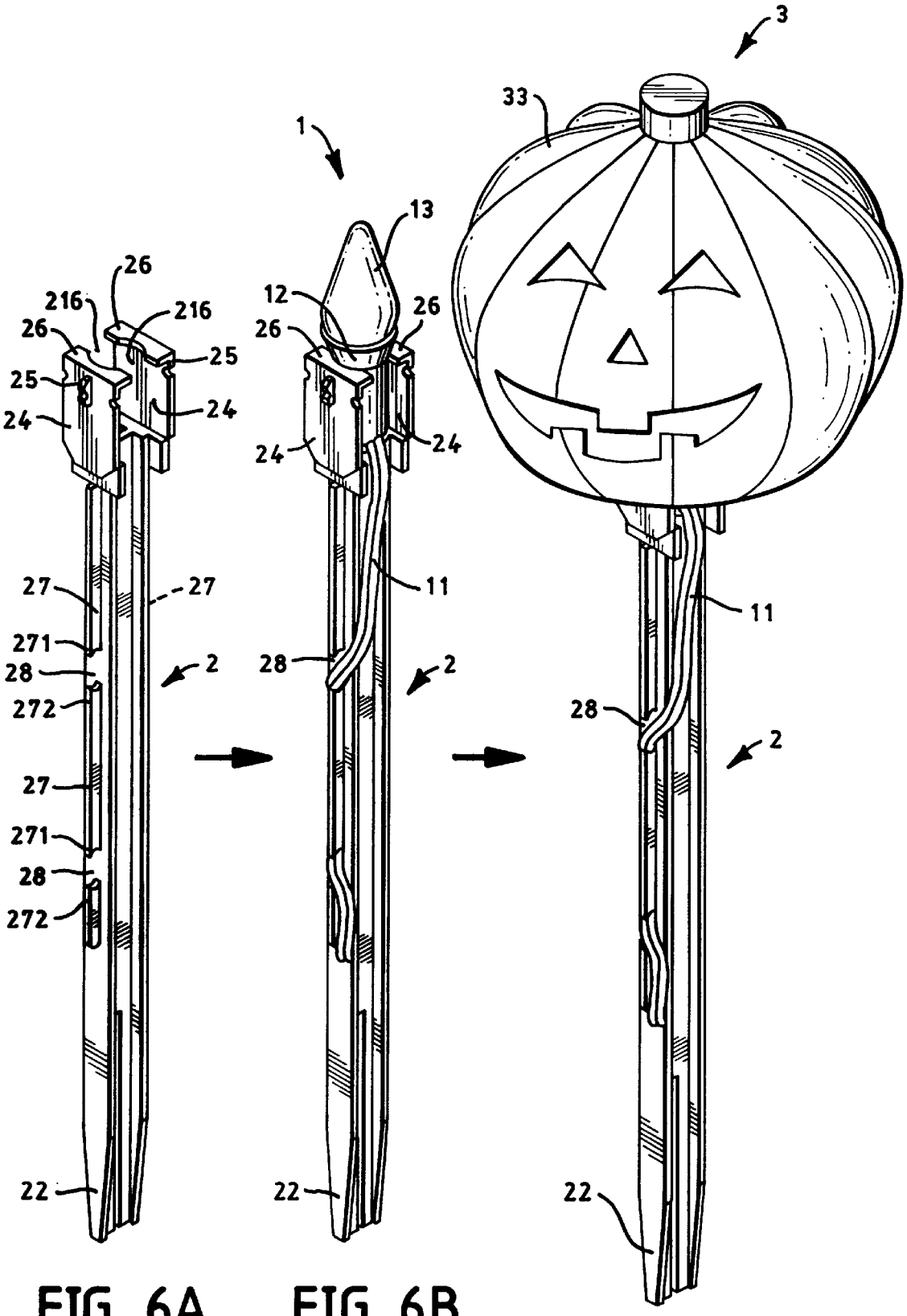
FIGS. 6A, 6B, 6C show the assembly of the lamp device in accordance with the present invention.

Referring to FIGS. 6, 7, the land lamp device according to the invention comprises a light string 1, a post 2 and a lamp cover. The light string 1 is composed of multiple leads 11, a lamp socket 12 and a bulb 13. The post 2 has a connecting plate 21 including a upper plate 211 and a lower plate 212. The upper plate 211 is connected to a fastening portion 23 which has two protection walls 24. On the upper end of the protection walls 24, multiple extension pieces 25 are formed. The extension piece 25 has a upper lug 251 and a lower lug 252 with a recess 253 formed between. Two protection walls 24 extend inward to form arc pieces 26 having arc recesses 261. The lower plate 212 is connected to a tip portion 22 which has two tips 221,222 in form of fork to form a recess 223 between. Multiple longitudinal rugs 27 are set on side of the connecting plate 21 with multiple hooklike recesses 271,272 formed on the rugs. An opening 28 is formed between two hooklike recesses 271,272. The lamp cover 3 has a hollow portion 32 inside and a decoration 31 with a hole 311 on a fastening portion 31, in which a clamp 312 is set along the edge of the hole. Elastic notches or crevices (not shown) can be formed on the clamp 312. For assembly, the lamp socket 12 of the light string 1 are installed between said two protection walls 24 of the fastening portion 23 and the bottom of the socket 12 is firmly connected to the upper plate 211 of the connecting plate 21. The upper edge of the lamp socket 12 or bulb 13 is clamped between arc recesses 261. The leads 11 extend down from one side or both sides of the lamp socket 12 to be firmly hooked on the opening 28 between the hooklike recesses 271,272. The hole 311 on the lamp cover 3 is set on the extension pieces 25 through the bulb 13. Then the clamp 312 can be clamped to the recess 253 between the upper lug 251 and lower lug 252 on the extension pieces 25. Therefore, while the bulb 13 or socket 12 is put inside the decoration 33, reflection or deflection of light form the bulb 13 by the decoration 33 results the various decorative patterns as the bulb 13 is lighting. Furthermore, two tips 221,222 connected to the lower plate 212 of the post 2 can be inserted into land or something loose to stand the land lamp.

Figure 8:
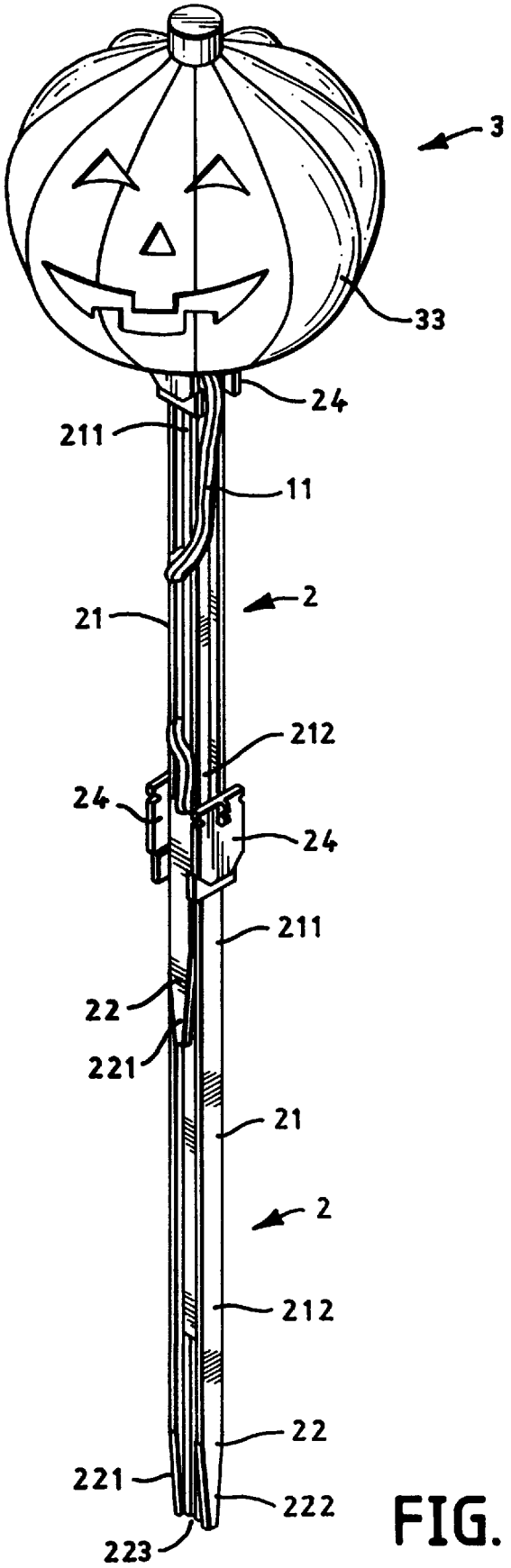
FIG. 8 shows the lengthened type of the land lamp device in accordance with the prevent invention.

Referring to FIG. 8, in the land lamp device of the invention, the recess 223 between two tips 221,222 is inserted between the two protection walls 24 on the upper plate 211 of another post. Thus, the tip portion 22 is clamped between two longitudial lugs 27 of the connecting plate 21 to form a lengthened type of land lamp without any lean of the post.

The features and preferred embodiments of the present invention have been described in the foregoing specification. The invention intended to be protected herein, however, is not to be construed as limited to the particular forms disclosed. Variations and changes which may be made by those skilled in the art are without departing from the scope of the present invention.

What is claimed is:

1. A lamp device comprising:

a light string with a plurality leads, a plurality lamp sockets and a plurality bulbs;

a plurality of posts, each post having a tip portion at one end and a fastening portion at the other end and a connecting plate with an upper plate portion connected to said fastening portion and a lower plate portion connected to said tip portion, said tip portion having two tips providing a fork forming a recess on said lower plate portion of said connecting plate, said fastening portion having two protection walls, each protection wall having an extension piece formed thereon, each extension piece having an upper lug and a lower lug providing a recess between said upper lug and said lower lug, said tip portion being able to be inserted into the ground or into something loose to support the lamp device;

a plurality of lamp covers, said fastening portion of each post being connected to an associated lamp socket of said sockets, with an associated bulb of said bulbs and an associated one of said covers or to said tip portion of another post to form a lengthened post, each lamp cover having one of various patterns formed thereon, each lamp cover having a bottom with a fastening portion for securely connecting said lamp cover to said fastening portion of said post or to said associated lamp socket, with said associated bulb disposed substantially centrally inside said cover whereby reflection or deflection of light by said cover results in various decorative patterns as the bulb when the bulb is lighting, said lamp cover having a hollow portion inside defining a hole, said hole cooperating with said fastening portion with said fastening portion providing a clamping along the edge of the hole, said associated lamp socket and said associated bulb being installed between said two protection walls and a bottom of said associated socket being firmly connected to said upper plate portion of said connecting plate with said leads extending down from one side or each side of said associated lamp socket to another lamp socket for connection, said clamping along the edge of the hole including said edge of the hole being inserted in said recess between said upper lug and said lower lug on said protection walls, locating said bulb substantially centrally inside said cover.

2. The lamp device as claimed in claim 1, wherein lugs are formed on edges of said connecting plate and extend in a region between said fastening portion and said tips.

3. The lamp device as claimed in claim 2, wherein each of said edges has two lugs.

4. The lamp device as claimed in claim 2, wherein said two tips of said post can be inserted between said protection walls of said fastening portion of another post and said tips can be hooked between two lugs on said connecting plate without any leaning of the post.

5. The lamp device as claimed in claim 1, said tips can be inserted between two protection walls of said fastening portion of another post and a recess formed by said tips can be inserted into said upper plate portion of said post, so that said upper plate portion and said lower plate portion can be firmly connected without any leaning of said post.

6. The lamp device as claimed in claim 5, wherein said two tips of said post can be inserted between said protection walls of said fastening portion of another post and said tips can be hooked between two lugs on said connecting plate without any leaning of the post.

7. The lamp device as claimed in claim 1, wherein said extension pieces are one of two opposite pieces, four opposite pieces and six opposite pieces.

8. The lamp device as claimed in claim 1, wherein said clamping action provided by said fastening portion is provided by multiple notches of said fastening portion.

9. A lamp device comprising:

a light string with a plurality leads, a plurality lamp sockets and a plurality bulbs;

a plurality of posts, each post having a tip portion at one end and a fastening portion at the other end and a connecting plate with an upper plate portion connected to said fastening portion and a lower plate portion connected to said tip portion, said tip portion having two tips providing a fork forming a recess on said lower plate portion of said connecting plate, said fastening portion having two protection walls, each protection wall having an extension piece formed thereon, each extension piece having an upper lug and a lower lug providing a recess between said upper lug and said lower lug, said tip portion being able to be inserted into the ground or into something loose to support the lamp device, said protection walls each having an arc portion with an inward arc recess formed on a top of said protection wall;

a plurality of lamp covers, said fastening portion of each post being connected to an associated lamp socket of said sockets, with an associated bulb of said bulbs and an associated one of said covers or to said tip portion of another post to form a lengthened post, each lamp cover having one of various patterns formed thereon, each lamp cover having a bottom with a fastening portion for securely connecting said lamp cover to said fastening portion of said post or to said associated lamp socket, with said associated bulb disposed substantially centrally inside said cover whereby reflection or deflection of light by said cover results in various decorative patterns as the bulb when the bulb is lighting, said lamp cover having a hollow portion inside defining a hole, said hole cooperating with said fastening portion with said fastening portion providing a clamping along the edge of the hole, said associated lamp socket and said associated bulb being installed between said two protection walls held by said arc portions and a bottom of said associated socket being firmly connected to said upper plate portion of said connecting plate with said leads extending down from one side or each side of said associated lamp socket to another lamp socket for connection, said clamping along the edge of the hole including said edge of the hole being inserted in said recess between said upper lug and said lower lug on said protection walls, locating said bulb substantially centrally inside said cover.

10. The lamp device as claimed in claim 9, wherein multiple lugs are formed on edges of said connecting plate and extend in a region between said fastening portion and said tips.

11. The lamp device as claimed in claim 10, wherein each of said edges has two lugs.

12. The lamp device as claimed in claim 10, wherein said two tips of said post can be inserted between said protection walls of said fastening portion of another post and said tips can be hooked between two lugs on said connecting plate without any leaning of the post.

13. The lamp device as claimed in claim 10, wherein multiple pairs of hooklike opposite recesses are formed on said lug of said connecting plate and said lead can be firmly hooked on an opening formed by a pair of recesses to be fastened to said post.

14. The lamp device as claimed in claim 9, said tips can be inserted between two protection walls of said fastening portion of another post and a recess formed by said tips can be inserted into said upper plate portion of said post, so that said upper plate portion and said lower plate portion can be firmly connected without any leaning of said post.

15. The lamp device as claimed in claim 14, wherein said two tips of said post can be inserted between said protection walls of said fastening portion of another post and said tips can be hooked between two lugs on said connecting plate without any leaning of the post.

16. The lamp device as claimed in claim 14, wherein multiple pairs of hooklike opposite recesses are formed on said lug of said connecting plate and said lead can be firmly hooked on an opening formed by a pair of recesses to be fastened to said post.

17. The lamp device as claimed in claim 9, wherein said extension pieces are one of two opposite pieces, four opposite pieces and six opposite pieces.

18. The lamp device as claimed in claim 9, wherein said clamping action provided by said fastening portion is provided by multiple notches of said fastening portion.

19. A lamp device comprising:

a light string with a plurality leads, a plurality lamp sockets and a plurality bulbs;

a plurality of posts, each post having a tip portion at one end and a fastening portion at the other end and a connecting plate with an upper plate portion connected to said fastening portion and a lower plate portion connected to said tip portion, said tip portion having two tips providing a fork forming a recess on said lower plate portion of said connecting plate, said fastening portion having two protection walls, each protection wall having an extension piece formed thereon, each extension piece having an upper lug and a lower lug providing a recess between said upper lug and said lower lug, said tip portion being able to be inserted into the ground or into something loose to support the lamp device, said protection walls each having an arc portion with an inward arc recess formed on a top of said protection wall, connecting plate lugs being provided on an edge of said connecting plate said connecting plate lugs extending in a region between said fastening portion and said two tips to define hook-like recesses forming an opening;

a plurality of lamp covers, said fastening portion of each post being connected to an associated lamp socket of said sockets, with an associated bulb of said bulbs and an associated one of said covers or to said tip portion of another post to form a lengthened post, each lamp cover having one of various patterns formed thereon, each lamp cover having a bottom with a fastening portion for securely connecting said lamp cover to said fastening portion of said post or to said associated lamp socket, with said associated bulb disposed substantially centrally inside said cover whereby reflection or deflection of light by said cover results in various decorative patterns as the bulb when the bulb is lighting, said lamp cover having a hollow portion inside defining a hole, said hole cooperating with said fastening portion with said fastening portion providing a clamping along the edge of the hole, said associated lamp socket and said associated bulb being installed between said two protection walls held by said arc portions and a bottom of said associated socket being firmly connected to said upper plate portion of said connecting plate with said leads hooked in said opening of said hook-like recesses and extending down from one side or each both side of said associated lamp socket to another lamp socket for connection, said clamping along the edge of the hole including said edge of the hole being inserted in said recess between said upper lug and said lower lug on said protection walls, locating said bulb substantially centrally inside said cover.

* * * * *